United States Patent [19]

Dunsmoor

[11] 4,300,794

[45] Nov. 17, 1981

[54] CLOSURE FASTENER

[75] Inventor: Forrest L. Dunsmoor, Atlanta, Ga.

[73] Assignee: Peachtree Doors, Inc., Norcross, Ga.

[21] Appl. No.: 102,376

[22] Filed: Dec. 11, 1979

[51] Int. Cl.[3] ..... E05C 5/02

[52] U.S. Cl. ..... 292/247; 292/DIG. 31; 292/DIG. 49

[58] Field of Search ..... 292/247, 113, DIG. 31, 292/DIG. 49, 66

[56] References Cited

U.S. PATENT DOCUMENTS

| | | | |
|---|---|---|---|
| 3,034,817 | 5/1962 | Willis | 292/DIG. 31 |
| 3,534,992 | 10/1970 | Swanson | 292/247 X |
| 3,584,906 | 6/1971 | Budzyn | 292/247 |
| 3,706,467 | 12/1972 | Martin | 292/247 |
| 4,025,094 | 5/1977 | Mitchell | 292/DIG. 31 |

*Primary Examiner*—Richard E. Moore

*Attorney, Agent, or Firm*—D. Paul Weaver

[57] ABSTRACT

A positive acting non-handed flush mounted fastener or lock ideally suited to casement windows and other swinging closures is provided. No parts project into the room to interfere with window hangings and when the sash or other closure is locked, no parts project into the light or sight line. A compound locking action employing a pivoted locking lever, a latch connected with the locking lever through a toggle and toggle link, and a cam track for the toggle link and latch provided in a casing for the lock develops great force to draw in or release a sash or other closure.

10 Claims, 8 Drawing Figures

CLOSURE FASTENER

BACKGROUND OF THE INVENTION

The prior art contains many teachings pertaining to toggle type closure fasteners. Some examples of prior United States patents of general interest in relation to this invention are the follwing, made of record herein under 37 C.F.R. 1.56:

U.S. Pat. No. 497,445
U.S. Pat. No. 567,621
U.S. Pat. No. 783,338
U.S. Pat. No. 1,339,174
U.S. Pat. No. 1,863,863
U.S. Pat. No. 1,899,822
U.S. Pat. No. 3,109,675
U.S. Pat. No. 3,145,038
U.S. Pat. No. 3,162,419
U.S. Pat. No. 3,174,784
U.S. Pat. No. 3,534,992
U.S. Pat. No. 3,706,467
U.S. Pat. No. 4,049,301

A prime object of the invention is to improve on the known prior art through provision of a closure fastener which is non-handed in comparison to conventional casement and awning type window locks. The mechanism embodied in the invention includes a shallow lock case and filler element which can be flush mounted on one side of a casement window frame and the like so that no parts of the mechanism project into the window sight line when the lock is closed and no parts project into the room to cause interference with window hangings in any position of the mechanism. The entire mechanism is simple, extremely strong and durable and very compact.

Another important object of the invention is to provide an action which is very powerful for drawing a sash or other closure inwardly or forcing it outwardly to release a stuck sash. This action involves an over-dead-center mechanism which inhibits forced entry because of a tendency of the mechanism to tighten the locking action rather than release it in response to opening pressure on the closure or sash.

Another object and feature of the invention is the provision in the fastener or lock of an essentially straight line draw-in motion which is not critical in relation to alignment with the keeper or strike mounted on the sash.

Other objects and advantages of the invention will appear to those skilled in the art during the course of the following detailed description.

SUMMARY OF THE INVENTION

A shallow lock case adapted to be flush mounted in the frame of a swinging closure forms the pivotal support for a lock lever and a coacting toggle arm. Both of these elements have lost motion connections with a wire form toggle link which in turn has a pivotal connection with a latch having a sash mounted keeper or strike receiving slot. During manual movement of the mechanism from a release to a locking position, the pivotally connected latch and toggle link are guided along cam slots in side walls of the lock case, so that the latch is moved gradually into engagement with the sash mounted keeper or strike.

DETAILED DESCRIPTION

Figure 1:
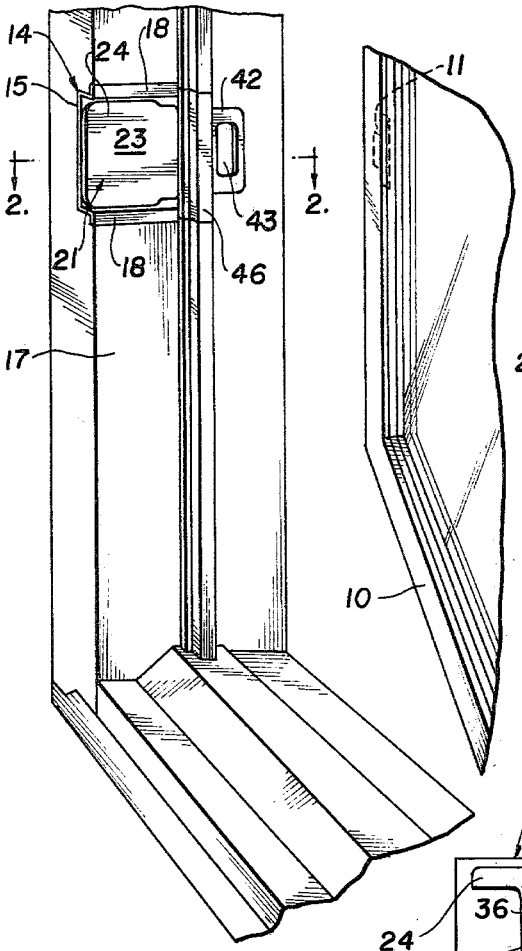
FIG. 1 is a fragmentary perspective view of a casement window equipped with the fastener or lock embodying the invention.
Figure 2:
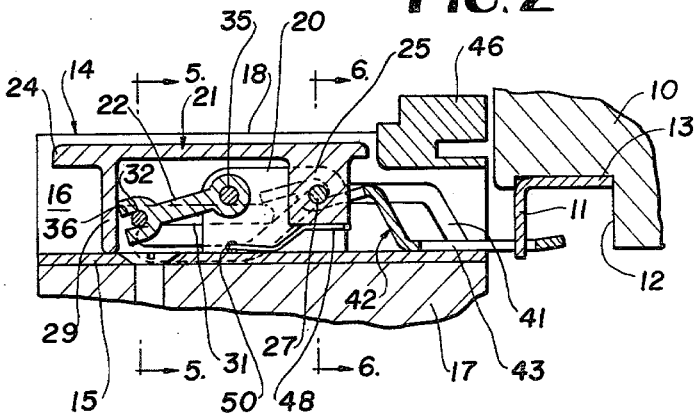
FIG. 2 is an enlarged horizontal section taken on line 2—2 of FIG. 1 showing the fastener or lock closed in relation to a swinging sash having a keeper.
Figure 3:
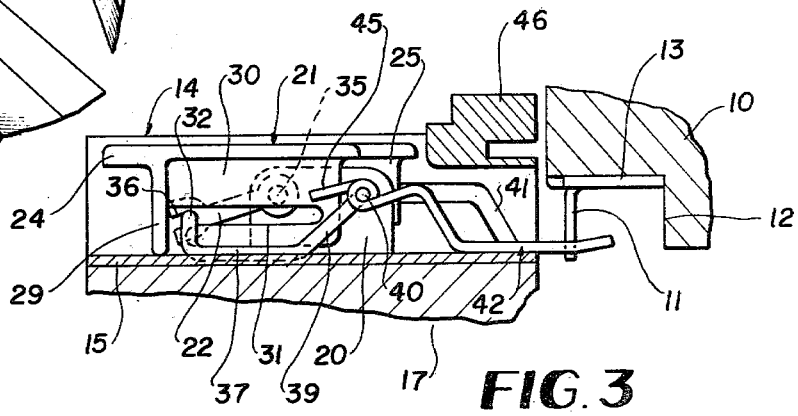
FIG. 3 is a similar horizontal section showing the lock and keeper in elevation.
Figure 4:
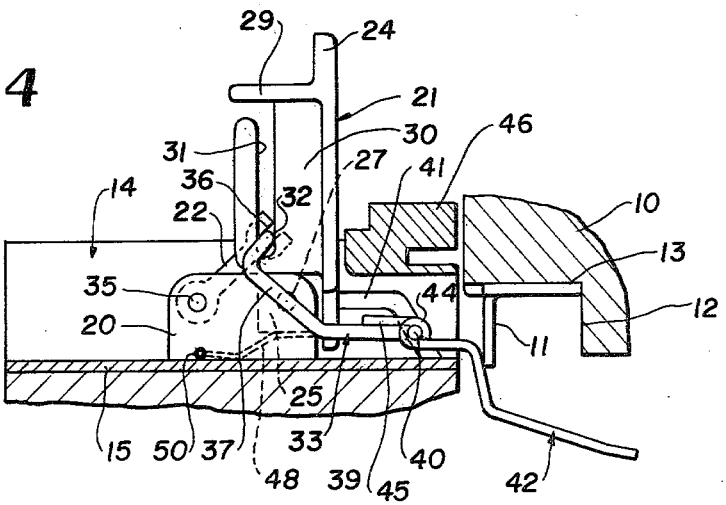
FIG. 4 is a view similar to FIG. 3, showing the lock in a full release position relative to the sash and keeper.

Referring to the drawings in detail, wherein like numerals designate like parts, FIG. 1 illustrates a casement window including a swinging sash 10 upon which is mounted a keeper 11 or strike. As shown in FIGS. 2, 3 and 4, the keeper 11 is mounted in a recess 12 of the sash 10 and includes a mounting plate 13 at right angles to the keeper tongue proper.

The fastener or lock comprises a channel-like case 14 of comparatively shallow depth having a flat bottom wall 15 and side walls 16 at right angles thereto. The lock case 14 and the parts carried thereby to be described is adapted to be flush mounted on one side 17 of the casement window frame, FIG. 1, within a mortised recess of such frame side. The lock case 14 has top and end locator flanges 18 and 19 thereon, as shown. When the case 14 is installed on the frame side 17, FIG. 1, its bottom wall 15 shown in FIG. 7 and elsewhere is vertically disposed. In this connection, the lock is ideally suited to horizontally swinging closures, such as casement windows, but may also be used with awning-type windows and a number of other types of closures. In such case, the lock case 14 may be positioned in a different manner from that shown in FIG. 1 for a casement window. It will be understood that the invention is quite versatile in this respect.

The lock case 14 has a pair of spaced parallel ears 20 rising from its bottom wall 15 centrally of the case. These ears form the anchor for a manually operated lock lever 21 and a latch toggle 22. The lock lever 21 has a flat outer wall 23 lying slightly below the locator flanges 18 when the lock is closed, FIGS. 2 and 5, including a projecting finger grip portion or flange 24 for ease of operation. At its opposite end toward the exterior of the window frame, FIG. 1, and away from the finger grip portion 24, the lock lever 21 is provided on its interior or underside with a boss 25 having a through bore 26 for a pivot pin 27 whose opposite ends are supported in aligned openings 28 of the spaced ears 20. The lever 21 has a transverse stop web 29 formed thereon inwardly of flange 24 and adapted to engage the bottom wall 15 of lock case 14 when the lever 21 is in the closure locking position, FIGS. 2 and 3.

On opposite sides of the boss 25 in spaced parallel relationship, and inwardly of the two side edges of lock lever 21, a pair of actuator bosses 30 are positioned on the lever below its outer wall 23. These actuator bosses have longitudinal cam slots 31 formed therein to receive slidably the cross bar 32 of a generally U-shaped toggle link 33, to be further described.

Figure 5:
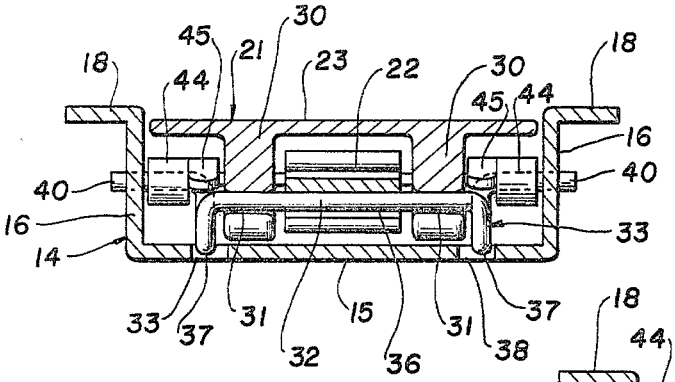
FIG. 5 is a vertical section taken on line 5—5 of FIG. 2 on an enlarged scale.

The latch toggle 22 is received between the two ears 20 and has a through bore 34 for an independent pivot pin 35 parallel to the pin 27. The far end of toggle 22 is bifurcated to provide an engaging groove 36 in the pivoted toggle for the cross bar 32 of toggle link 33. Thus, the cross bar 32 is arranged to be driven by the toggle 22 when the latter is turned on its pivot and is simultaneously guided by the slots 31 in bosses 30 of the lock lever 21, as best shown in FIG. 5.

Figure 7:
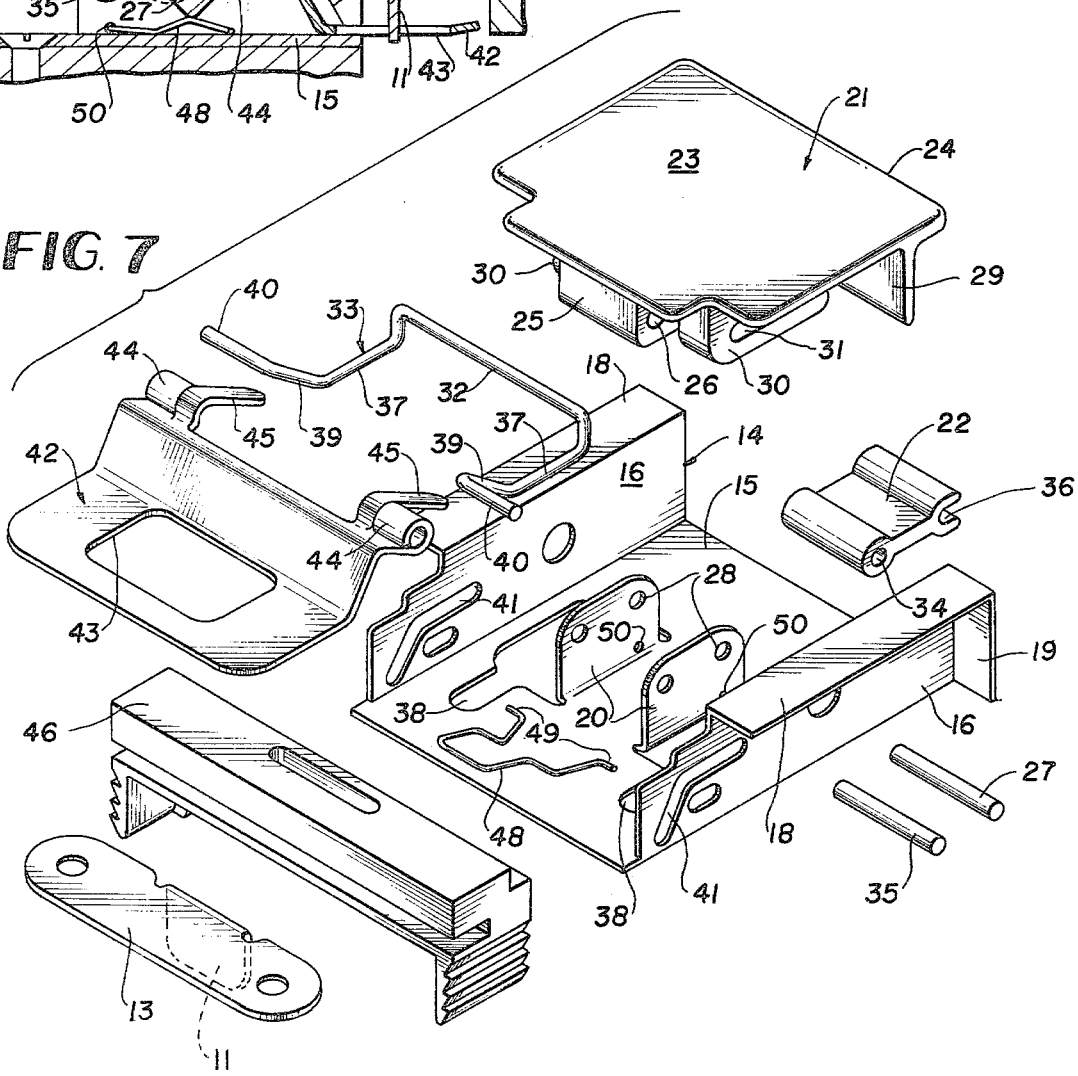
FIG. 7 is an exploded perspective view of the fastener or lock.

The toggle link 33 further comprises side depressed parallel arms 37 adapted to be received in clearance openings 38 formed through the bottom wall 15 of lock case 14. The toggle link further includes angled arm portions 39 and end coaxial terminals or trunnions 40, transversely of the lock case 14 and received slidably in guide or cam slots 41 of lock case side walls 16. As best shown in FIGS. 3 and 7, the slots 41 have inclined sections rising from the bottom wall 15 near the exterior end of the lock case leading into horizontal portions which are parallel to the wall 15 and flanges 18.

The toggle link 33 is pivotally coupled with a latch 42 having a receiver opening or slot 43 for the sash mounted keeper 11. As shown in FIG. 1, the latch projects outwardly on the frame side 17 toward the swinging sash 10 which is swung to and from the closed position by an operator, not shown, or by a handle.

Figure 6:
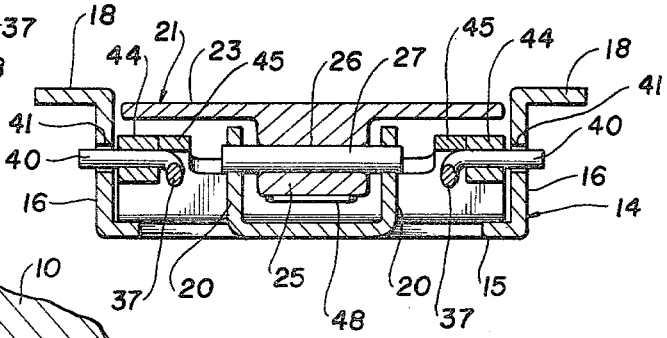
FIG. 6 is a similar section taken on line 6—6 of FIG. 2.

The latch 42 is pivotally coupled to the toggle link 33 by bearings or knuckles 44 which pivotally receive the trunnions 40. Immediately inwardly of the two knuckles 44, the latch has a pair of inclined fingers 45 thereon which are positioned directly over the parallel arms 37 of the toggle link to engage these arms during the opening of the lock, FIGS. 4A and 4, to assure the outward swinging of the latch 42 away from the keeper 11 so that the sash 10 is released. The relative positions of important elements in the mechanism can best be seen in FIGS. 5 and 6. The relatively narrow latch toggle 22 is located between the two ears 20, as stated, while the arms 37 of toggle link 33 are outboard of the bosses 30 on the lock lever 21 and between these bosses and the side walls 16 of the lock case. Similarly, the knuckles 44 and fingers 45 are between the bosses 30 and side walls 16. The structure is highly compact in the lateral direction between the side walls 16 and depth-wise between the flanges 18 and bottom wall 15. This compactness is what allows the flush mounting of the lock in a window frame or the like, as illustrated.

A lock filler 46 is provided as a part of the lock assembly to fill the gap in jamb stop 47, FIG. 1, produced in the mortising operation on the window frame which conditions it to receive the lock case 14.

A spring 48 in the form shown in FIG. 7 underlies the boss 25 of lock lever 21 and also bears on top of the bottom wall 15. End terminals 49 of this spring are anchored in openings 50 of the two ears 20. This spring serves to stabilize the lock lever 21 both in the locking position, FIG. 2, and in the full release position, FIG. 4, by acting on two right angular surfaces of the boss 25.

SUMMARY OF OPERATION

When the window sash 10 has been swung by any suitable operator toward the closed position in the window frame, its keeper 11 will approach the position shown in FIG. 4 with the lock lever extending inwardly from the adjacent side of the window frame substantially at right angles thereto. At this time, the slots 31 of the lock lever have caused shifting of the latch toggle 22 and toggle link 33 to the position shown in FIG. 4, wherein the arm portions 39 are parallel to the bottom wall 15 and the trunnions 40 are near the bottoms of slots 41 and relatively close to the wall 15. At this time, the fingers 45 are being engaged by the arm portions 39 to assure that the latch 42 is positively swung to clear the keeper 11. This same condition of elements would exist if one were opening the window sash 10, and the keeper 11 would be clear of the latch 42.

Figure 4A:
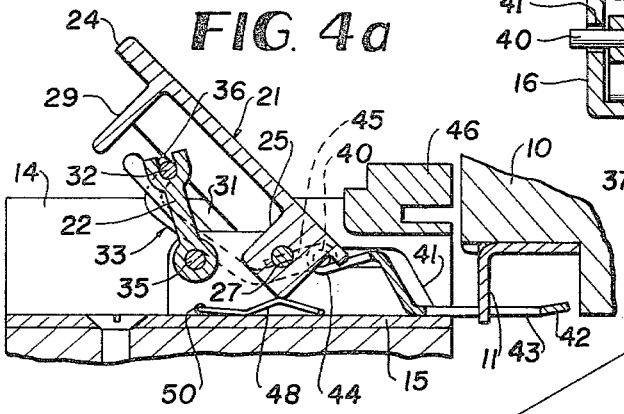
FIG. 4A is a similar view showing the lock in an intermediate position.

In the sash locking sequence, the lock lever 21 is now grasped and swung toward parallelism with the window frame side 17 and through the intermediate postion of FIG. 4A to the locked position shown in FIGS. 2 and 3. In so doing, the lock lever through its slots 31 cams or drives the cross bar 32 of toggle link 33 and the latch toggle 22 toward their positions in FIGS. 2 and 3. The latch toggle 22 rotates counterclockwise on its pivot pin 35 and its groove 36 drives or pulls the toggle link 33 with it toward the position of FIGS. 2 and 3. The trunnions 40 of the toggle link 33 ride to the tops of guide slots 41 and the arms 37 move down into the clearance openings 38 of the lock case. Thus, the toggle link has imparted to it a combined pivoting and shifting movement between the positions shown in FIGS. 4 and 3. This movement of the toggle link 33 causes the latch 42 to first swing inwardly toward the projecting keeper 11 so that the keeper will enter the latch opening 43. Further movement of the mechanism draws the latch 42 inside of the open ended lock case 14, FIGS. 2 and 3, with the latch substantially riding on the wall 15 of the lock case. Great power is generated through the toggle mechanism due to the compound action developed through the short pivoted toggle 22 and trailing pivoted link 33 under influence of the longer pivoted lock lever 21 whose pivot 27 is spaced considerably from the pivot 35 of the shorter toggle 22.

When the full locking position is reached and the web 29 is in contact with the wall 15, a past-dead-center relationship exists between the forked end of the toggle 22 holding the cross bar 32 and the two pivot pins 35 and 27, as shown in FIGS. 2 and 3. This over-center action of the mechanism prevents forced entry, as previously mentioned. The use of wire for the toggle link 33 provides full security while allowing shock or misalignment compensation. The mechanism is simple and easily understood even by a child enabling the closure to be opened in a panic situation. The invention is adaptable to panic security locking, as by placing a frangible rod across the latch as is done with fire alarms. When the lock is open, FIG. 4, the latch 42 will come to rest against the side surface of the window frame.

Another feature of the device is that there are no points, hooks or the like projecting from it likely to cause injury. Also, the appearance of the fastener or lock is clean and attractive as can be seen in FIG. 1. The many features and advantages of the invention should now be apparent to those skilled in the art without the necessity for further description.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A closure fastener comprising a case adapted for flush mounting in a recess formed in a closure frame, said case being of channel formation including a bottom wall and side walls, anchor elements rising from said bottom wall and spaced from said side walls, said side walls having guide slots formed therein, a lock lever adapted to lie bodily within the case and being pivoted to said anchor elements and having cam slots, a latch toggle pivotally attached to said anchor elements in spaced relationship to the pivot axis of said lock lever, a toggle link having a pivotal connection with said latch toggle and being engaged with said cam slots of the lock lever, said toggle link having trunnions, said trunnions being slidably engaged with said side wall guide slots, a latch element pivotally coupled with said trunnions and adapted to be drawn by movement of the toggle link substantially inside of said case when the lock lever is pivoted to a locking position within the case and substantially parallel to said bottom wall of the case, said latch toggle assuming a past-dead-center condition relative to the pivot axis of the lock lever when the lock lever is in said locking position, and said latch element adapted for engagement with and disengagement from a keeper element on a closure with which the closure fastener is employed.

2. A closure fastener as defined in claim 1, and a stabilizing spring connected to said case in underlying relationship to a boss on said lock lever having two right angular surfaces each engageable with said spring and said surfaces and spring disposed near the pivot axis of said lock lever.

3. A closure fastener as defined in claim 1, and said latch element comprising a plate element having a keeper receiving opening formed therethrough and having coaxial bearing parts rotatably receiving said trunnions, and fingers projecting from said plate element near said bearing parts and overlying side arm portions of said toggle link to cause pivoting of said plate element to a keeper release position when the lock lever is pivoted to the unlocking position, and said toggle link being formed of wire.

4. A closure fastener as defined in claim 1, and said lock lever having an exterior flat wall substantially covering the open side of said channel formation case when the lock lever is in a locking position substantially parallel to said bottom wall, and a stop web on said lock lever projecting inwardly from said flat wall and adapted to contact said bottom wall of the case when the lock lever is in said locking position.

5. A closure fastener as defined in claim 4, and said lock lever having a pair of spaced bosses on one side thereof containing said cam slots and having an intermediate boss provided with a pivot opening, and a pivot pin pivotally connecting the intermediate boss with said anchor elements of said case.

6. A closure fastener as defined in claim 1, and said toggle link being generally U-shaped and having a cross bar, and said latch toggle having a forked end pivotally engaging said cross bar to forcibly drive said toggle link in response to pivotal movement of the lock lever.

7. A closure fastener as defined in claim 1, and said latch toggle being substantially shorter in the radial direction away from its pivot axis than said lock lever in the radial direction away from its pivot axis.

8. A closure fastener as defined in claim 1, and said side wall guide slots having longitudinal portions and inclined portions relative to the side walls of said case.

9. A closure fastener as defined in claim 1, and a filler bar element attachable to said case near one end of the case to fill a gap in a jamb stop of a closure frame caused by the preparation of said frame to accept the closure fastener.

10. A closure fastener as defined in claim 1, and said latch element comprising a generally flat portion having a keeper element opening and adapted to contact said bottom wall when said lock lever is in a locking position and further comprising an offset portion pivotally coupled with said trunnions of said toggle link.

* * * * *